United States Patent [19]

Tajima et al.

[11] Patent Number: 5,013,028

[45] Date of Patent: May 7, 1991

[54] DEVICE FOR CHANGING A PASSAGEWAY OF PAPER

[75] Inventors: Akio Tajima; Ryoichi Fujimoto, both of Tokyo, Japan

[73] Assignee: Seikosha Co., Ltd., Tokyo, Japan

[21] Appl. No.: 488,341

[22] Filed: Mar. 2, 1990

[30] Foreign Application Priority Data

Mar. 8, 1989 [JP] Japan ..... 1-55921

[51] Int. Cl.[5] ..... B65H 39/10

[52] U.S. Cl. ..... 271/305; 271/297

[58] Field of Search ..... 271/297, 305, 303

[56] References Cited

U.S. PATENT DOCUMENTS

| | | | |
|---|---|---|---|
| 4,026,540 | 5/1977 | Lawrence | 271/297 |
| 4,111,410 | 9/1978 | Tates et al. | 271/297 |
| 4,116,429 | 9/1978 | Van Buskirk et al. | 271/297 |
| 4,469,323 | 9/1984 | Miyashita et al. | 271/297 |
| 4,501,419 | 2/1985 | Takahashi et al. | 271/297 |
| 4,555,106 | 11/1985 | Ruenzi | 271/305 |

FOREIGN PATENT DOCUMENTS

| | | | |
|---|---|---|---|
| 48151 | 4/1980 | Japan | 271/297 |

*Primary Examiner*—Joseph E. Valenza
*Assistant Examiner*—Steve Reiss
*Attorney, Agent, or Firm*—Jordan and Hamburg

[57] ABSTRACT

A device for changing a passageway for paper includes flaps pivotably provided at branching points of the passageway and operable to change the paper feeding direction. Solenoids mounted with shafts are extended by first springs during non-energizing and retract during energizing, and second springs are provided for imparting biasing forces to follow the displacement of the shafts and to pivotably bias the flaps so that the flaps receive rotational moments of force acting in opposite directions in the energizing and non-energizing states, the rotational moment of force being set so as not to hinder the feed of the paper.

20 Claims, 4 Drawing Sheets

DEVICE FOR CHANGING A PASSAGEWAY OF PAPER

BACKGROUND OF THE INVENTION:

The present invention is directed to a device for changing the direction in which a sheet of paper is fed when the paper printed by a printer is carried toward a sorter.

Provided at branching points of a passageway for the paper according to the prior art are flaps which are selectively pivoted, thereby changing the feeding direction of the paper. A means for pivotably driving the flaps is arranged in such a way that solenoids are joined directly to the flaps pivoted in a desired direction by turning the solenoids on and off.

Based on the prior art described above, however, the flaps are pivotably driven after the paper has completely passed a juxtaposed flap. Unless the flaps are controlled in this manner, the paper that is being fed is seized by the top end of the juxtaposed flap to hinder the feed thereof, resulting in such a drawback that the paper is damaged. Hence, problems arise peculiar to the prior art, wherein it takes a great deal of time to change the paper feeding direction, which in turn causes a drop in the effective printing speed of the printer.

SUMMARY OF THE INVENTION:

It is an object of the present invention, which has been made to obviate the foregoing problems inherent in the prior art, to provide a device for changing over a passageway of paper which is capable of changing over flaps without waiting for the complete passage of the paper past a juxtaposed flap to thereby increase the effective printing speed of a printer.

To this end, according to one aspect of the present invention, there is provided a device for changing a passageway for paper, comprising flaps provided pivotably at branching points of the passageway of the paper for changing the feeding direction of the paper; solenoids including operating shafts extended by the spring force of first springs during non-energizing thereof and retracted while resisting the spring force of the first springs during energizing thereof; and second springs for imparting to the flaps a biasing force in such a direction as to follow displacement of the operating shafts, wherein the flaps receive rotational moments of force acting in directions opposite to each other by the resultant forces of the first and second springs during non-energizing of the solenoid and by the spring force of the second spring during energizing of the solenoid, and the rotational moments of force are set to a magnitude so as not to hinder the paper feed by the pressing force of the flaps on the paper which are caused due to such rotational moments of force.

BRIEF DESCRIPTION OF THE DRAWINGS:

Other objects and advantages of the invention will become more apparent during the following discussion taken in conjunction with the accompanying drawings.

The drawings in combination show one embodiment of a device for changing a passageway of paper according to the present invention.

DESCRIPTION OF THE PREFERRED EMBODIMENTS:

One embodiment of the present invention will hereinafter be described in detail with reference to the accompanying drawings.

Figure 1:
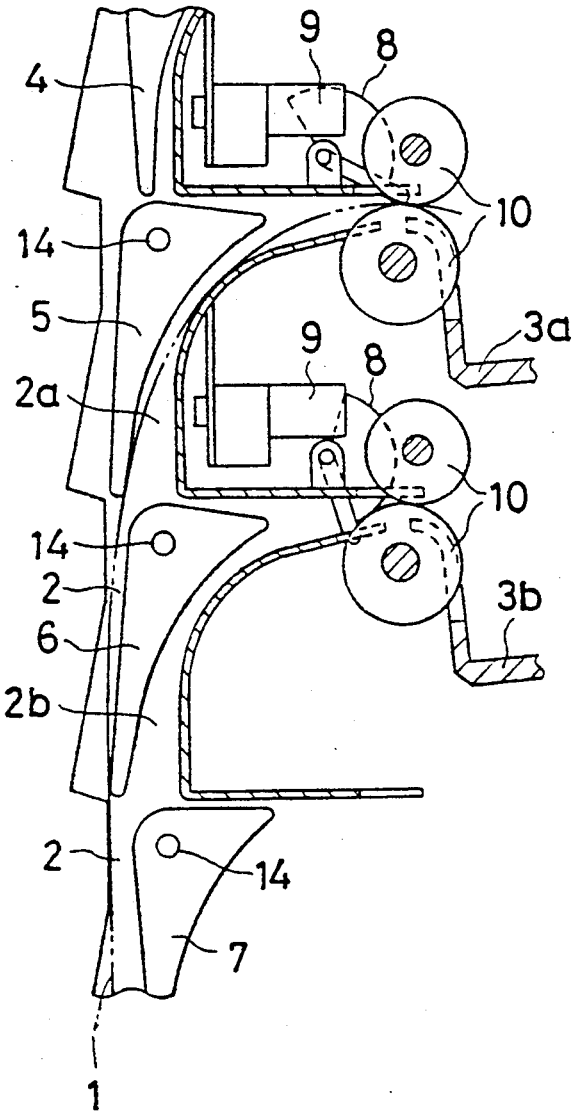
FIGS. 1, 3, 5 and 7 are principal front elevational views each illustrating a state where a passageway for the paper is changed over and also showing the operation thereof.

Sheets of paper 1 printed by an unillustrated printer are, as illustrated in FIG. 1, fed in a rising direction and pass via sub-passageways 2*a* and 2*b* branched off from a passageway 2. The papers 1 are then allocated to a plurality of stackers 3*a* and 3*b* of a sorter which are located up and down in alignment preparatory to subsequent feeding. Retained pivotably at branching points of the passageway 2 are flaps 4 through 7 for changing the feeding direction of the papers 2. Disposed between the branched sub-passageways 2*a* and 2*b* and the stackers 3*a* and 3*b* are a shade 8 raised when the papers 1 pass through the sub-passageways 2*a* and 2*b*, a sensor 9 for sensing the movement of the shade 8 and rollers 10 for ejecting the papers 1 from the sub-passageways 2*a* and 2*b* to the stackers 3*a* and 3*b*.

Figure 2:
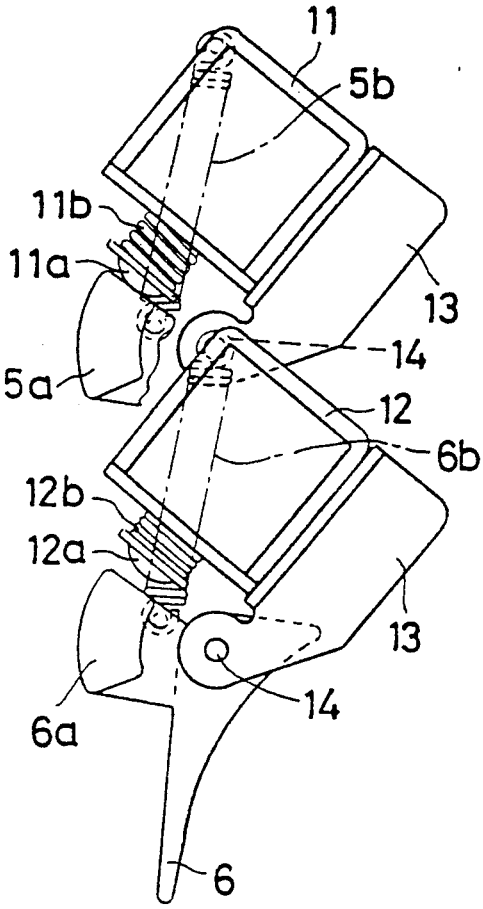
FIGS. 2, 4, 6 and 8 are principal front elevational views each illustrating a driving unit for changing over flaps and also showing the operation thereof.

As shown in FIG. 2, solenoids 11 and 12 for pivotably driving the flaps 5 and 6 are attached thereto via supporting plates 13. The respective flaps are pivotably supported via shafts 14 on the supporting plates. The solenoids for pivotably driving the flaps 4 and 7, though not illustrated, have the same configuration.

The solenoids 11 and 12 are equipped with operating shafts 11*a* and 12*a* which extend and retract depending on their energizing state or non-energizing state. The operating shafts 11*a* and 12*a* are wound with first springs 11*b* and 12*b*. More specifically, the operating shafts 11*a* and 12*a* are extended by the spring forces of the first spring 11*b* and 12*b* during non-energizing of the solenoids 11 and 12, whereas during energizing thereof, the operating shafts retract resisting the spring forces thereof.

Secured to the flaps 5 and 6 are second springs 5*b* and 6*b* for imparting biasing forces in such a direction as to follow the displacement of the operating shafts 11*a* and 12*a*. Namely, protrusions 5*a* and 6*a* formed integrally with the flaps 5 and 6 are operably engageable with the operating shafts 11*a* and 12*a*. Secured to the protrusions are the second springs 5*b* and 6*b* having smaller spring forces than those of the first springs 11*b* and 12*b*. Imparted to the flaps 5 and 6 are the resultant forces of the first and second springs 11*b*, 12*b*, 5*b* and 6*b* during non-energizing of the solenoids 11 and 12, i.e., a rotational moment acting in the counterclockwise direction as a result of the difference between the spring forces which is determined by f1–f2, where f1 is the spring forces of the first springs 11*b* and 12*b*, and f2 is the spring forces of the second springs 5*b* and 6*b*, and also a rotational moment acting in a clockwise direction by the spring forces f2 of the second springs 5*b* and 6*b* during energizing thereof. Thus, the rotational forces acting in the opposite directions depend on the energizing or the non-energizing of the solenoids 11 and 12.

The magnitude of the rotation moment is set so as not to hinder the feed of the paper 1 by the pressing forces of the flaps 5 and 6 and not to damage the paper 1.

The description will next be focused on the operation of the device of the invention.

In the situation shown in FIGS. 1 and 2, the paper, 1 passing through the passageway 2 is being led to the upper sub-passageway 2a and is ejected to the stacker 3a, in which state the upper solenoid 11 is brought into a non-energizing state to provide for ejecting the subsequent paper to the stacker 3b as the lower solenoid 12 is energized.

Figure 3:
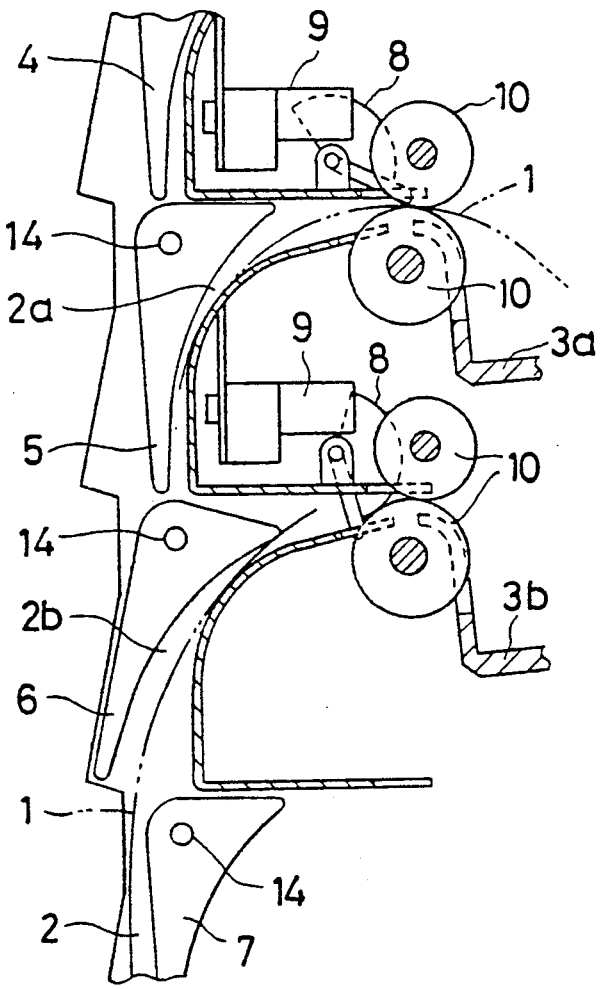
Figure 4:
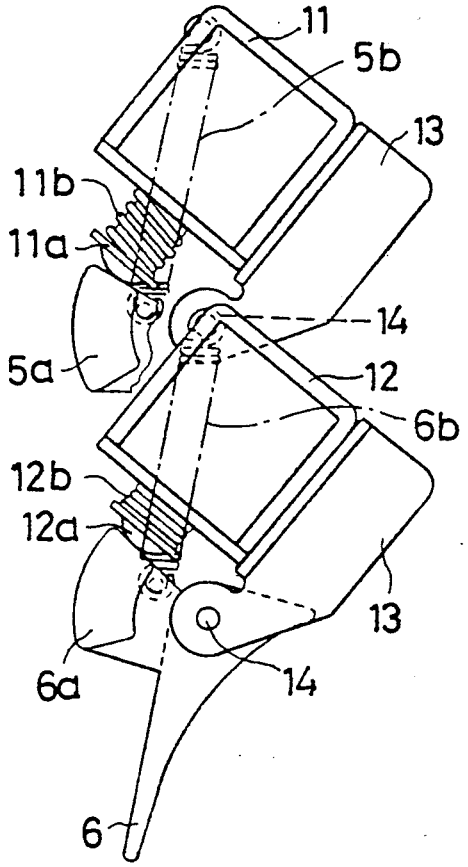

When the solenoid 12 is charged with the electricity, the operating shaft 12 retracts resisting the spring force of the first spring 12b, and a clockwise rotational moment is imparted so that the flap 6 follows it by the spring force of the second spring 6b. However, the paper 1, which is being ejected to the stacker 3a, still continues to pass at the top end of the flap 6, and hence the flap 6 is unable to sufficiently pivot, with the result that the flap 6 presses the paper 1 by the rotational moment associated with the spring force of the second spring 6b as shown in FIG. 1. As discussed above, the rotational moment is set so as not to hinder the feed of the paper 1, so that the paper 1 continues to be fed, though it undergoes the pressing force from the flap 6. When the rear end of the paper 1 passes past the flap 6, as shown in FIG. 4, the flap 6 pivots to a position in which the flap 6 impinges on the operating shaft 12a disposed in a retracted position of the solenoid 12, thereby opening a branched path leading to the sub-passageway 2b. The paper 1 is thus, as illustrated in FIG. 3, led to the sub-passageway 2b.

As stated earlier, when the solenoid is brought into the non-energizing state, the operating shaft 11a is extended by the spring force of the first spring 11b, while the spring force of the second spring 5b works to oppose the movement of this operating shaft. The resultant forces of two springs serve to determine the amount of extension of the operating shaft 11a, and a counterclockwise rotational moment is imparted via the protrusion 5a to the flap 5. At this time, the rear end of the paper has not yet passed through the top end of the flap 5, and it follows that the flap 5 receiving the rotational moment presses against the paper 1. As described above, the rotational moment has a magnitude which does not block the feed of the paper 1, and hence the paper 1 continues to be fed, though it is pressed by the flap 5. Subsequently, the paper 1 is ejected to the stacker 3a. After the rear end of the first paper 1 has, as illustrated in FIG. 3, completely passed beyond the top end of the flap 5, the operating shaft 11a is, as shown in FIG. 4, extended to a predetermined position, thereby closing the branched path to the sub-passageway 2a because of the flap 5 pivoting sufficiently.

Figure 5:
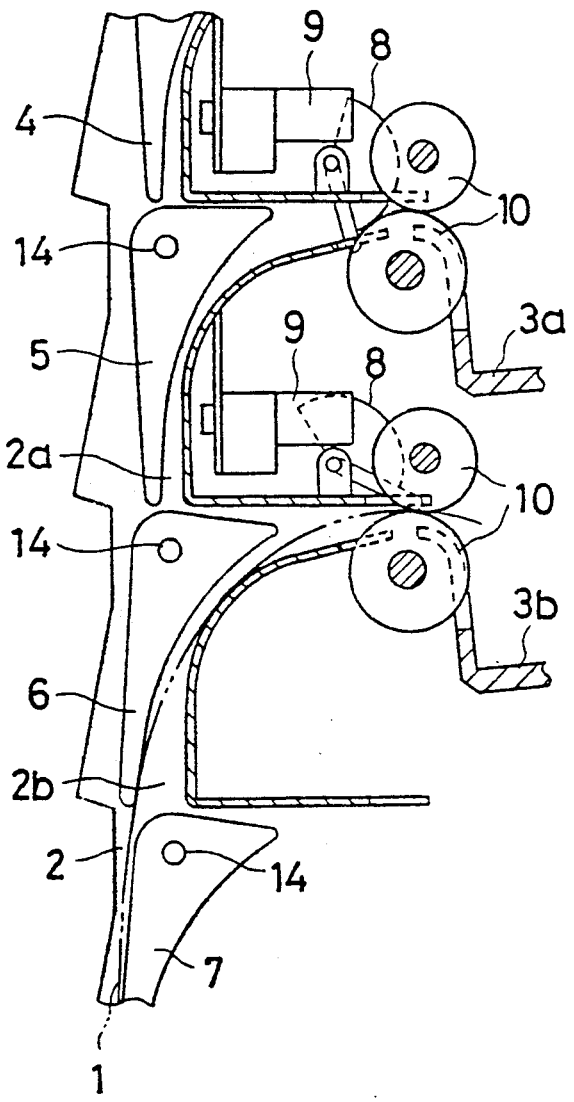
Figure 6:
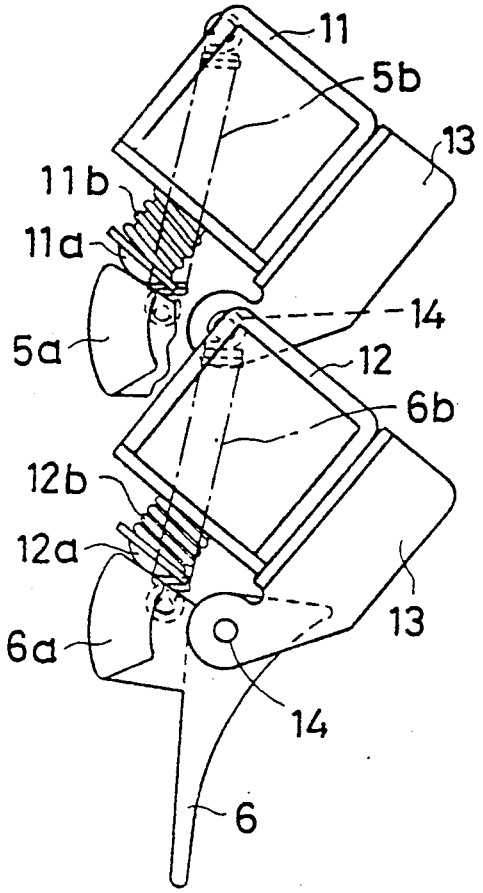
Figure 7:
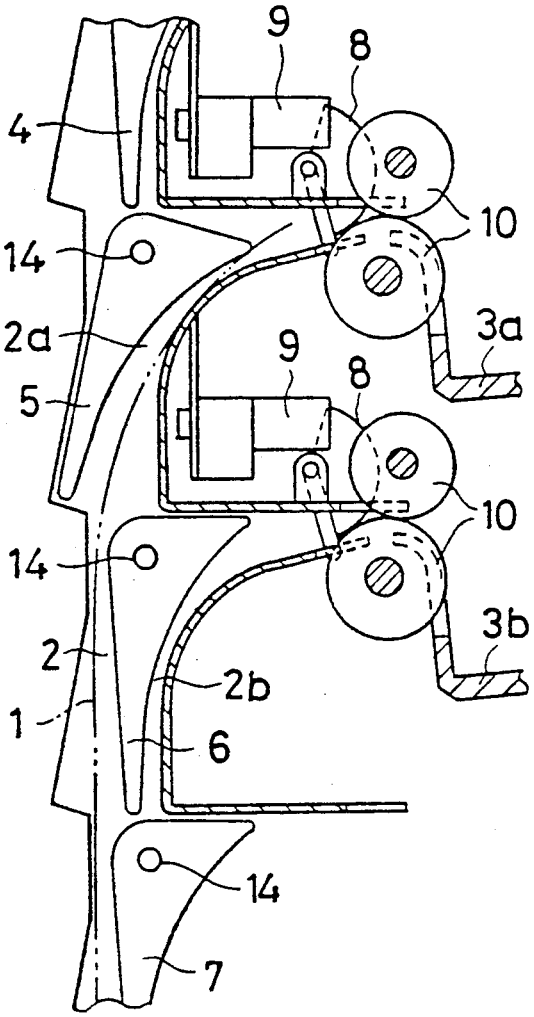
Figure 8:
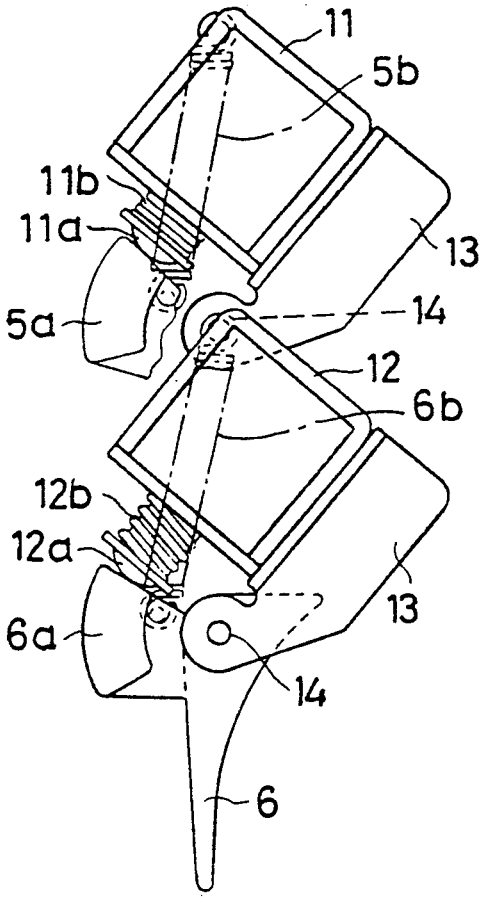

In the case of ejecting the paper 1 to the stacker 3a once more, as illustrated in FIG. 6, the solenoid 12 is put into the non-energizing state. With this arrangement, a counterclockwise rotational moment is, as in the previous case, imparted to the flap 6 by the resultant forces of the first and second springs 12b and 6b. Thus, the flap 6 presses the paper 1, as in the preceding case, with a force that does not hinder the feed of the paper 1 until the rear end of the paper 1, as depicted in FIG. 5, completely passes beyond the top end of the flap 6. When the rear end of the paper 1 has completely passed beyond the top end of the flap 6, however, the operating shaft 12a is, as shown in FIGS. 7 and 8, extended to the predetermined position, and the flap pivots sufficiently. The branched path to the sub-passageway 2b is thereby closed. It follows from this shut-off that the paper is further carried along the passageway 2.

The solenoid 11 is, as illustrated in FIG. 8, charged with electricity. This energizing process causes the operating shaft 11a to retract as in the previous case, and the flap 5 also follows it by the spring force of the second spring 5b,thus imparting a clockwise rotational moment thereto. At this time, since the paper does not yet come to the top end of the flap 5, the flap 5 sufficiently pivots to thereby open the branched path leading to the sub-passageway 2a. Then, the next paper 1 is, as shown in FIG. 7, guided to the sub-passageway 2a and is thereafter ejected to the stacker 3a.

As discussed above, the thus constructed device for changing the passageway for the paper according to the present invention is capable of changing over the flaps without waiting for the complete passage of the paper and therefore increasing the effective printing speed of the printer. Besides, when changing the passageway, even if the flap impinges on the paper, there is no damage to the paper.

Although the illustrative embodiment of the present invention has been described in detail with reference to the accompanying drawings, it is to be understood that the present invention is not limited to this precise embodiment. A variety of modifications or changes may be effected therein by one skilled in the art without departing from the scope or spirit of the invention.

What we claim is:

1. In an apparatus for changing a passageway for paper comprising:

pivotably mounted downstream flap means and pivotably mounted upstream flap means juxtaposed to respective downstream and upstream diverting paper paths and also juxtaposed to a main paper path;

downstream control means and upstream control means for controlling pivotal movement of each of said downstream and upstream flap means respectively;

said downstream control means having one operable state in which said downstream control means positions said downstream flap means to guide one paper sheet to said downstream diverting path;

said upstream control means having a concurrent operable state in which said upstream control means applies a biasing force to said upstream flap means in one rotational direction to bias said upstream flap means into biasing contact with said one paper sheet being fed to said downstream diverting path such that said one paper sheet restrains further pivotal movement of said upstream flap means in said one rotational direction;

said upstream flap means being triggered to pivot further in said one rotational direction to a diverting position when the trailing edge of said one paper sheet passes said upstream flap means and said one paper sheet no longer restrains said pivotal movement of said upstream flap means, said upstream flap means when in said diverting position being disposed within said main paper path to divert the next paper sheet fed along said main paper path to said upstream diverting path.

2. In an apparatus according to claim 1 wherein each of said downstream and upstream control means comprises a first spring means biasing the respective flap means in one rotational direction, a solenoid means having an openable shaft along with second spring means operable to bias the respective flap means in an opposite rotational direction when said solenoid means is non-energized, said shaft moving in a retracted direction against the bias of said second spring means when said solenoid means is energized.

3. In an apparatus according to claim 2 wherein said downstream flap means has a non-diverting position to which said downstream flap means is biasing pivoted with an operable biasing force, said non-diverting position being outside of said main paper path, said operable biasing force being the resulting rotational biasing force of said first and second spring means applied to said downstream flap means.

4. In an apparatus according to claim 3 wherein said downstream control means when in said one operable state causes said downstream flap means to biasingly engage said one paper sheet being fed to said downstream diverting path with an operable biasing force, said operable biasing force being the resulting rotational biasing force of said first and second spring means, said downstream flap means being triggered to pivot further in said other rotational direction to said non-diverting position when the trailing end of said one paper sheet passes said downstream flap means and said downstream flap means no longer biasingly engages said one paper sheet.

5. In an apparatus according to claim 2 wherein the solenoid means of said upstream control means is in said energized state when said upstream flap means is triggered to pivot to said diverting position, the solenoid means of said upstream control means being in said energized state when said upstream flap means is in said diverting position.

6. In an apparatus according to claim 2 wherein the solenoid means of said downstream control means is in its non-energized state when said downstream control means is in its one operating state, the solenoid of said upstream control means being in its energized state when said upstream control means is in its one operating state.

7. In an apparatus according to claim 2 wherein the resulting rotational biasing force of said first and second spring means is applied to said downstream flap means when said downstream control means is in said one operating state.

8. In an apparatus according to claim 2 wherein the biasing force of said first spring means is unapplied to said upstream flap means when said upstream control means is in its one operable state.

9. In an apparatus according to claim 2 wherein the solenoid means of said upstream control means is energized when said upstream control means is in said one operable state.

10. In an apparatus according to claim 1 wherein said downstream control means when in said one operable state is operable to apply a biasing force to said downstream flap means in an opposite rotational direction to bias said downstream flap means into biasing contact with said one paper sheet being fed to said downstream diverting path such that said one paper sheet restrains further pivotal movement of said downstream flap means in said opposite rotational direction, said downstream flap means being triggered to pivot further in said opposite rotational direction to a non-diverting position when the trailing edge of said one paper sheet passes said downstream flap means and said one paper sheet no longer restrains said pivotal movement of said downstream flap means, said downstream flap means when in said non-diverting position being disposed outside said main paper path.

11. In an apparatus according to claim 10 wherein each of said downstream and upstream control means comprises first spring means biasing the respective flap means in said one rotational direction, a solenoid means having an operable shaft along with second spring means operable to bias the respective flap means in an opposite rotational direction when said solenoid means is non-engaged, said shaft moving in a retracted direction against the bias of said second spring means when said solenoid means is energized, the solenoid means of said downstream control means being in a non-energized state when said downstream flap means is triggered to pivot to said non-diverting position, the solenoid of said downstream control means being in said non-energized state when said downstream flap means is in said non-diverting position.

12. In an apparatus according to claim 11 wherein the resulting rotational biasing force of said first and second spring means is applied to said downstream flap means when said downstream control means is in its one operating state.

13. In an apparatus according to claim 1, wherein said downstream control means comprises a plurality of first operating parts, and said upstream control means comprises a plurality of second operating parts which are substantially the same as said plurality of first operating parts.

14. Apparatus for changing a passageway for paper comprising:

support means;

a plurality of flap means each pivotably mounted on said support means and each juxtaposed to a diverting paper path and also juxtaposed to a main paper path;

a plurality of first spring means connected to said support means and biasing each of said flap means in one rotational direction;

a plurality of solenoid means each mounted on said support means and each having an operable shaft along with second spring means operable to bias said shaft in an extended direction and to bias said flap means in an opposite rotational direction when said solenoid means is non-energized, said shaft moving in a retracted direction against the bias of said second spring means when said solenoid means is energized;

said apparatus having one operable state in which a downstream solenoid means associated with a downstream flap means and an associated downstream diverting path is non-energized such that said downstream flap means is operable to guide said one paper sheet to said downstream diverting path;

said apparatus when in said one operable state having an upstream solenoid means associated with an upstream flap means and an associated upstream diverting path which is energized such that said first spring means applies a biasing force to said upstream flap means in said opposite rotational direction to bias said upstream flap means into biasing contact with said one paper sheet being fed to said downstream diverting path as said one paper sheet restrains further pivotable movement of said upstream flap means in said one direction;

said apparatus being triggered to another operable state when the trailing edge of said one paper sheet passes said upstream flap means and said one sheet of paper no longer restrains said pivotal movement of said upstream flap means such that said upstream flap means is thereby biasingly pivoted further in said one direction to a diverting position within said main paper path to divert the next paper sheet fed along said main paper path.

15. Apparatus for changing a passageway for paper sheets comprising:

support means;

a plurality of flap means each pivotably mounted on said support means and each juxtaposed to a diverting paper path and also juxtaposed to a main paper path;

a plurality of first spring means connected to said support means and biasing each of said flap means in one rotational direction;

a plurality of solenoid means each mounted on said support means and each having an operable shaft along with second spring means operable to bias said shaft in an extended direction and to bias said flap means in an opposite rotational direction when said solenoid means is non-energized, said shaft moving in a retracted direction against the bias of said second spring means when said solenoid means is energized;

said apparatus having one operable state in which one solenoid means associated with one flap means and one diverting path is non-energized such that the resulting rotational biasing force applied by said first and second spring means to said one flap means pivotably biases said one flap in said opposite rotational direction against one side of one paper sheet being fed to said one diverting path;

said apparatus when in said one operable state having another solenoid means associated with another flap means and another diverting path which is energized such that said first spring means pivotably biases said other flap means in said one rotational direction against the other side of said one paper sheet being fed to said one diverting path.

16. Apparatus according to claim 15 wherein said operable shaft of said energized other solenoid means is spaced from said other flap means when said apparatus is in said one operable state such that said other flap means is pivotably biased in said one rotational direction solely by said first spring means.

17. Apparatus according to claim 15 wherein each of said flap means has an inside surface and an outside surface, said outside surface generally facing said main paper path, said inside surface generally facing the diverting path associated with the respective flap means, said inside surface of said one flap means engaging one side of said one paper sheet when said apparatus is in said one operable state, said outside surface of said other flap means engaging the other side of said one paper sheet when said apparatus is in said one operable state.

18. Apparatus according to claim 15 wherein said one paper sheet has a leading end portion and a trailing end portion, said leading end portion extending in said one diverting path when said apparatus is in said one operable state, said trailing end portion of said one paper sheet extending in said main paper path when said apparatus is in said one operable state, said first spring means pivotably biasing said other flap means against said trailing end portion of said one paper sheet with an operable rotational biasing force when said apparatus is in said one operable state, said operable rotational biasing force being of a magnitude to enable said trailing end portion of said one paper sheet to move and advance past said other flap means to said one diverting path while being biasingly engaged by said other flap means.

19. Apparatus according to claim 15 wherein said apparatus changes from said one operable to another operable state when the trailing edge of said one paper sheet passes by said other flap means such that said other flap means is no longer biased against said one paper sheet to thereby free said other flap means to pivot further in said one rotational direction to a diverting position in which said other flap means is disposed in said main paper path to divert the next paper sheet to another diverting path associated with said other flap means.

20. Apparatus according to claim 15 wherein said apparatus has a second operable state in which said other solenoid means is non-energized such that the resulting rotational biasing force of said first and second spring means is applied to said other flap means to pivotably bias said other flap means in said other rotational direction against one side of said sheet of paper being fed to said other diverting path.

* * * * *